US007333397B2

(12) United States Patent
Crettex

(10) Patent No.: US 7,333,397 B2
(45) Date of Patent: Feb. 19, 2008

(54) CALENDAR CORRECTOR

(75) Inventor: Frédéric Crettex, Prangins (CH)

(73) Assignee: Vaucher Manufacture Fleurier S.A. (CH)

( * ) Notice: Subject to any disclaimer, the term of this patent is extended or adjusted under 35 U.S.C. 154(b) by 0 days.

(21) Appl. No.: 10/567,745

(22) PCT Filed: Aug. 5, 2004

(86) PCT No.: PCT/CH2004/000490

§ 371 (c)(1),
(2), (4) Date: Aug. 31, 2006

(87) PCT Pub. No.: WO2005/015323

PCT Pub. Date: Feb. 17, 2005

(65) Prior Publication Data

US 2007/0195649 A1 Aug. 23, 2007

(30) Foreign Application Priority Data

Aug. 12, 2003 (EP) ..... 03405589

(51) Int. Cl.
*G04B 19/24* (2006.01)
*G04B 27/00* (2006.01)

(52) U.S. Cl. ..... 368/28; 368/34

(58) Field of Classification Search ..... 368/28, 368/34–38

See application file for complete search history.

(56) References Cited

U.S. PATENT DOCUMENTS 212,882 A 3/1879 Baillot
1,846,962 A 2/1932 Gries
3,673,789 A * 7/1972 Tsuzuki et al. ..... 368/37
3,716,983 A * 2/1973 Tanaka et al. ..... 368/28
3,827,234 A * 8/1974 Imanishi ..... 368/38
4,257,113 A * 3/1981 Meister et al. ..... 368/35
4,291,397 A * 9/1981 Wuthrich et al. ..... 368/35
4,432,081 A * 2/1984 Schwartz et al. ..... 368/35

FOREIGN PATENT DOCUMENTS

FR 536251 A 4/1922
FR 793442 A 1/1936

OTHER PUBLICATIONS

PCT International Search Report, for PCT/CH2004/000490, mailed Jan. 11, 2005 (2 pages).

* cited by examiner

*Primary Examiner*—Vit W Miska
(74) *Attorney, Agent, or Firm*—Finnegan, Henderson, Farabow, Garrett & Dunner, LLP

(57) ABSTRACT

A calendar corrector is disclosed for arrangement in a movement of a watchmaking part provided with a calendar display and, for example, a thirty-one wheel which goes round in thirty-one days. In one implementation, the corrector comprises a manual control, enabling information relating to the fact that the current month comprises less than thirty-one days to be introduced, and programming means coupled to the thirty-one wheel, responding to the information introduced by the control, such that the display can be corrected automatically at the end of the current month.

25 Claims, 2 Drawing Sheets

CALENDAR CORRECTOR

This application is a national stage filing under 35 U.S.C. 371 of International Application No. PCT/CH2004/000490, filed on Aug. 5, 2004, which claims priority to European Application No. 03405589.7, filed on Aug. 12, 2003.

TECHNICAL FIELD

The present invention relates to timepieces that display the calendar. It relates more specifically, based on the same principle, to a manual calendar corrector mechanism for a simple calendar and to an automatic calendar corrector mechanism for a perpetual calendar.

BACKGROUND

In a watch, the calendar mechanism allows the date of the month to be indicated by means of a hand moving over the dial or by means of a disk rotating under the dial and showing its information through a window. This kind of system is well known to those skilled in the art and is described in detail, for example, in the work entitled "Théorie de l'horlogerie" by Reymondin et al., Fédération des Ecoles Techniques, 1798, ISBN 2-940025-10-X, pages 189 et seq.

It will be recalled that the calendar indicator, whether a disk or a hand, is actuated off the hours wheel, via the calendar gear-train the last element of which is a thirty-one wheel performing one revolution in thirty-one days by advancing by one step of 360/31° every twenty-four hours, at around midnight. In the case of a display using a hand, the hand is mounted so that it rotates as one with the shaft of this wheel. In the case of a display using a disk, this disk is driven by a finger integral with the thirty-one wheel.

For months comprising fewer than thirty-one days it is necessary, in the case of simple calendars, to make a manual correction. This operation can be performed either by rotating the winding stem in its quick date-setting position or by actuating a push-button fitted freely into the watch case middle. Of course, the operation has to be performed on the last day of a month comprising fewer than thirty-one days or on the first day of the next month.

In order to avoid the user having to perform such updates, various mechanisms, known as perpetual calendars, have been developed. They automatically adapt to the length of the months, sometimes even predicting leap years. A toothed wheel, known as a cam, has hollows the depths of which are correlated to the length of the months. Schematically speaking, the cam comprises forty-eight or twelve sectors, depending on whether or not the mechanism takes account of leap years. A complex assembly of several other cams and levers, one of which is equipped with a nose collaborating with the first cam, transmits to the thirty-one wheel the order to jump by one, two or three days at the end of a thirty-day, a twenty-nine-day or a twenty-eight-day month, respectively.

SUMMARY OF THE INVENTION

The initial object of the present invention is to propose a simple calendar corrector allowing the correction in the display of the date to be programmed simply on any day of a month comprising fewer than thirty-one days so that the correction is actioned on the last day.

More specifically, it relates to a simple calendar corrector intended to fit in a movement of a timepiece equipped with calendar-display means and with a thirty-one wheel that makes one revolution in thirty-one days. This corrector comprises:

- manual control means allowing information relating to the fact that the month in progress comprises fewer than thirty-one days to be input, and
- programming means comprising a clutch runner equipped with two coaxial toothed disks, namely a first disk that can be rotationally driven in a first direction by the thirty-one wheel and a second disk that can be rotationally driven in a second direction, the opposite to the first, by the control means, so that, at the end of the month in progress, the display means are automatically corrected.

The second object of the invention is to provide a perpetual calendar mechanism devoid of the customary cams and levers.

In order to achieve this second object, the perpetual calendar corrector according to the invention comprises:

- automatic control means which, during each month comprising fewer than thirty-one days, produce information relating to the correction that will have to be made at the end of said month, and
- programming means comprising a clutch runner equipped with two coaxial toothed disks, namely a first disk that can be rotationally driven in a first direction by the thirty-one wheel and a second disk that can be rotationally driven in a second direction, the opposite to the first, by the control means, so that, at the end of the month in progress, the display means are automatically corrected.

In both instances, whether in the case of a simple calendar or of a perpetual calendar, the disks are coupled together by a spring and by a system of pawls which are arranged in such a way that:

- the first disk rotates in the first direction independently of the second,
- the second disk drives the first when it rotates in the first direction, and
- the second disk does not drive the first when it rotates in the second direction, at that time merely loading said spring.

Furthermore, the programming means comprise:

- a finger fixed to the thirty-one wheel,
- a first lever pivotably mounted on the second disk and that can be actuated by said finger on the last day of the month, and
- a second lever mounted independent of the clutch runner, that can be actuated by the first lever when the latter is moved by the finger, immobilizing the second disk and releasing it when actuated in such a way that, subjected to the action of said spring, the first disk progresses rapidly in order to correct the calendar display.

BRIEF DESCRIPTION OF THE DRAWINGS

Other characteristics of the invention will become more clearly apparent from reading the description which follows, with reference to the attached drawing in which.

DETAILED DESCRIPTION

The mechanism according to the invention is intended to fit in the movement of a mechanical or electro-mechanical watch with calendar display. As the realization of this function is perfectly well known to those skilled in the art and does not specifically form part of the invention, it will not be described in detail.

Figure 1:
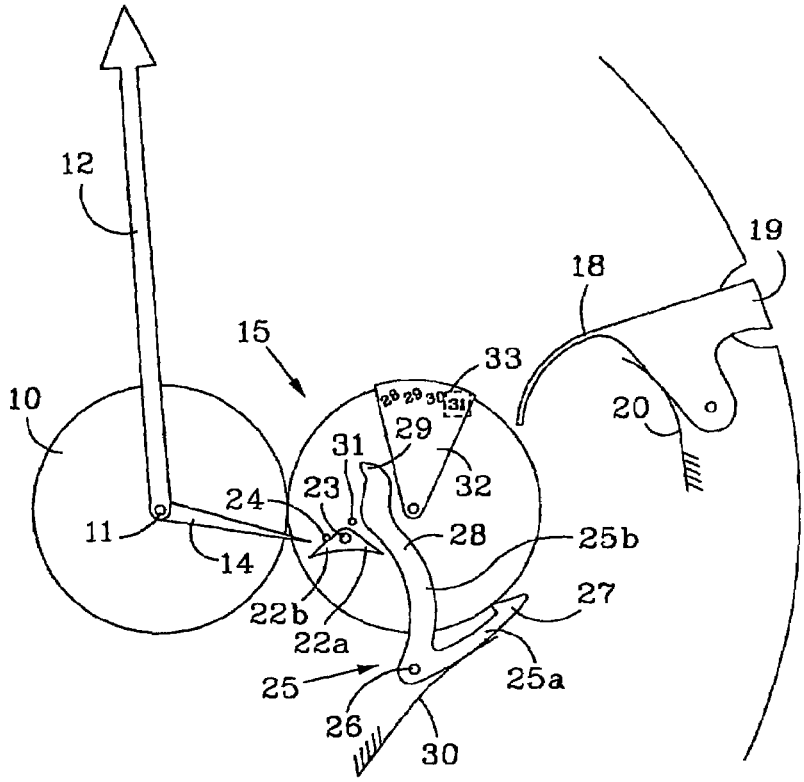
FIGS. 1 and 3 are views from above of the simple corrector according to the invention, at the end of thirty-one-day and twenty-eight-day months respectively.
Figure 2:
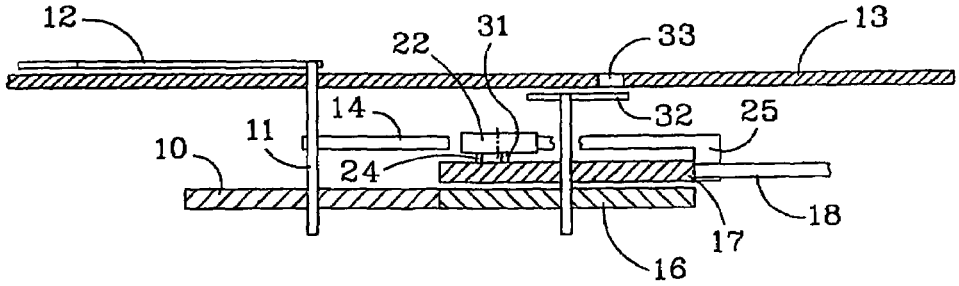
FIG. 2 is a view in cross section of the mechanism of FIG. 1.
Figure 3:
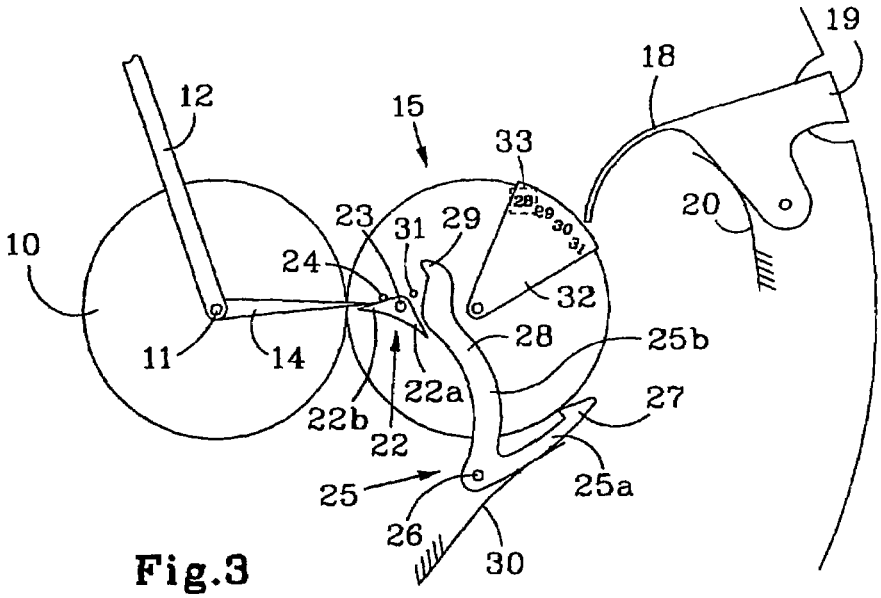

FIGS. 1 to 3 depict a thirty-one wheel 10 rotating in the clockwise direction (hereinafter CWD) at a rate of one revolution in thirty-one days. It bears, fixed to its shaft 11:

- a hand 12 indicating the date on a series of numerals ranging from 1 to 31, written on a dial 13, and
- a finger 14 the length of which exceeds the radius of the wheel 10.

The essential component in the mechanism is a clutch runner with pawls 15, comprising two coaxial toothed disks, a lower one 16 and an upper one 17. The lower disk 16 meshes with the thirty-one wheel 10 and therefore rotates in the counterclockwise direction (hereinafter CCWD). The upper disk 17 is driven in the CWD by a push-piece 18 protruding from the watch case middle to form a button 19 accessible to the wearer of the watch. Pressing the button 19 causes the disk 17 to move on by one step, that is to say by 360/31°, then a spring 20 returns the push-piece 18 to its initial position.

The runner 15 is provided, according to a construction well known to those skilled in the art, with pawls and with a spring which are positioned between the two disks 16 and 17 but which are not visible in the drawing. The lower disk 16 thus rotates in the CCWD independently of the upper disk 17 which drives the disk 16 only when it rotates in the CCWD but not when it rotates in the CWD, in such circumstances merely loading the spring.

A first lever 22, known as the small lever, is pivotably mounted about a spindle 23 on the upper face of the upper disk 17. It consists of two arms 22*a* and 22*b* typically making an angle of about 120° between them and facing, the first (22*a*) toward the inside and the second (22*b*) toward the outside of the disk. The outer arm 22*b* is normally held pressed against a stop 24 positioned at the periphery of the disk 17 by a spring (not depicted), while its end lies flush with the edge of the disk. It will be noted, as shown by FIG. 2, that the small lever 22 is at the same level as the finger 14 of the thirty-one wheel 10.

The mechanism comprises a second lever 25, known as the big lever, which pivots about a spindle 26 riveted to the plate. This lever is roughly L-shaped. Its short arm 25*a* is positioned at the upper disk 17 and ends in a lug 27 that a jumper 30 presses against the toothset of the disk so as to prevent it from rotating in the CCWD. The long arm 25*b* of the big lever 25 is arranged on the upper disk 17 and provided with a shoulder 28 designed in such a way as to take the thrust of the short arm 22*a* of the small lever 22. The long arm 25*b* ends in a boss 29 intended to experience the action of a safety block 31 riveted to the upper face of the disk 17 when the latter pivots in the CWD.

Advantageously, the series of numerals 28, 29, 30, 31 is written onto a portion of the periphery of an indicator disk 32 fixed to the shaft of the upper disk 17, above the latter. A window 33 made in the dial 13 reveals one of the numerals in the series, depending on the position of the disk 17. The usefulness of this indicator system will become more clearly apparent on reading the remainder of the description which explains how the mechanism according to the invention works.

In the course of a thirty-one-day month, there is no need to correct the calendar display. The thirty-one wheel 10 rotates the lower disk 16 of the clutch runner 15 in the CCWD, without that having any effect because the upper disk 17 is held immobile by the lug 27 and by the pressure of the jumper 30 on the short arm 25*a* of the big lever 25. The indicator disk 32 is then positioned in such a way that the numeral 31 of the series on the disk 32 appears through the window 33.

As the wheel 10 turns, the date display hand 12 performs its function in the normal way and the finger 14 moves over the upper disk 17 without its travel meeting the small lever 22.

During a twenty-eight-day month of February it is necessary to make a correction of three steps so that, on the twenty-eighth day of the month, at around midnight, the hand 12 skips the days 29, 30 and 31 and directly indicates the first day of the month of March.

In order to do this, on the day of his choosing during the month of February, the user presses three times in succession on the button 19 part of the push-piece 18, and this has the effect of rotating the upper disk 17 in the CWD by an angle of 3 times 360/31°. The lower disk 16 does not rotate but the spring of the runner 15 becomes loaded. The big lever 25 prevents the disk 17 from returning in the CCWD under the effect of the spring of the runner 15. Of course, as FIG. 3 shows, the small lever 22 and the safety block 31 are brought closer to the point of meshing of the thirty-one wheel 10 and the clutch runner 15. It is important to note that the long arm 22*b* of the small lever 22 is now in the path of the finger 14. More specifically, it is positioned in such a way as to meet it at the moment when the date indicator hand 12 moves on from the twenty-eighth to the twenty-ninth day. The numeral 28 in the series 28, 29, 30, 31 on the disk 32 then appears through the window 33.

When, on the twenty-eighth day of the month, at around midnight, the thirty-one wheel 10 moves on by one step, the finger 14 comes into contact with the long arm 22*b* of the small lever 22 and causes it to pivot about its spindle 23. The short arm 22*a* then presses against the shoulder 28 of the big lever 25, applying pressure greater than that exerted by the jumper 30. The big lever 25 pivots and the lug 27 breaks contact with the toothset of the upper disk 17.

Thus released, the upper disk 17 skips three steps in the CCWD, moved by the spring which suddenly unloads. At the same time it drives the lower disk 16 which meshes with the thirty-one wheel 10. The latter and the date indicator hand 12 therefore also skip three steps in the CWD.

The hand 12 then indicates the first day of the month of the series inscribed on the dial 13. The numeral 31 in the series on the indicator disk 32 shows again through the window 33.

For twenty-nine-day or thirty-day months, the mechanism works in the way that has just been described but the user presses twice or once on the button part 19 of the push-piece 18 in order thus to cause the upper disk 17 to move on by two steps or by one step, respectively.

There is no situation in which it is necessary to modify the calendar display by four days. Thus, were the wearer to press the push-piece 18 four times, the display will be one or more days out when moving on to the first day of the month. In addition, it could be inappropriate to apply excessive stress to the spring of the runner 15.

In order to circumvent these problems, when three corrections have been made, as in the example set out hereinabove, the safety block 31 lies at the base of the boss 29 of the long arm 25*b* of the big lever 25. Further pressure on the push-piece 18 causes the upper disk 17 to rotate by an additional step in the CWD and the block 31 pushes the boss 29 by applying a pressure greater than that exerted by the jumper 30. The big lever 25 in its turn pivots and the lug 27 breaks contact with the toothset of the upper disk 17, allowing the spring of the runner 15 to return to its rest position.

Thus, a calendar corrector mechanism is proposed that allows the correction that needs to be made to be programmed on any day of a month comprising fewer than thirty-one days, the correction being actioned on the last day of the month, at around midnight.

Figure 4:
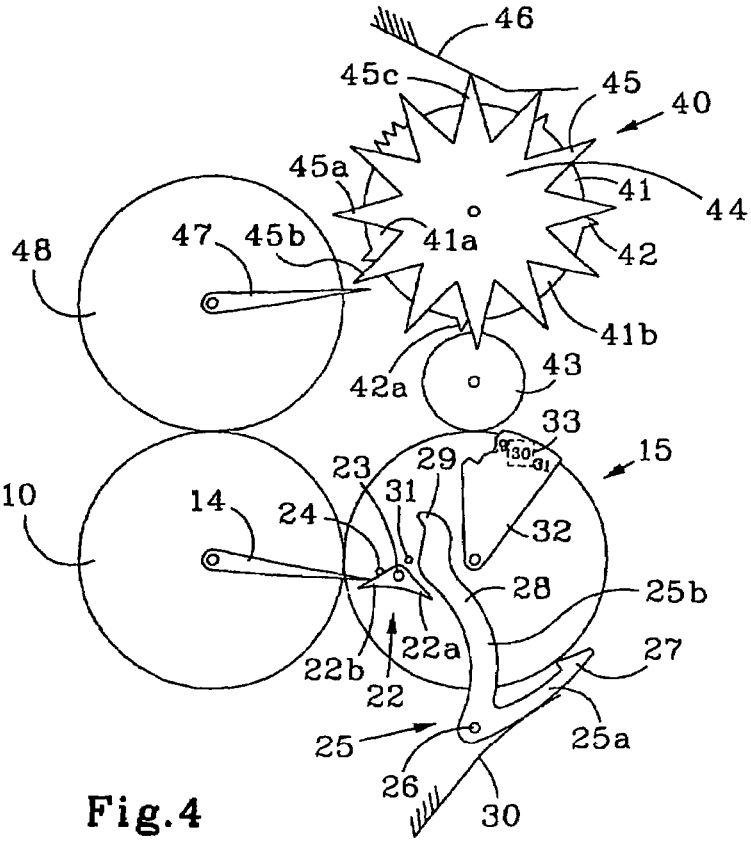
FIG. 4 is a view from above of the perpetual calendar mechanism at the end of a thirty-day month.

In order to avoid the user having to make the corrections himself, the present invention finds a second application in a perpetual calendar mechanism, illustrated in FIG. 4, which automatically takes account of the number of days in the various months.

This mechanism again includes:

the thirty-one wheel 10, the clutch runner with pawls 15, the small lever 22 and its stop 24, the big lever 25 and its jumper 30, and the indicator disk 32.

These various elements are arranged in the way described previously but, this time, the upper disk 17 is no longer driven by a push-piece.

The mechanism in FIG. 4 is set out in a simplified version that does not account for leap years. It comprises a months wheel 40 divided into twelve sectors 41 each corresponding to one month of the year. Each of these sectors 41 is either devoid of teeth, if identified with a thirty-one-day month or equipped with one tooth 42 in the case of thirty-day months, or equipped with three teeth 42 in the case of the month of February. These teeth 42 are positioned in a way that will be explained later on.

The teeth 42 are in mesh with an intermediate runner 43, itself meshing with the upper disk 17 of the clutch runner 15. The toothsets of these various runners have identical pitches, which means that an advance of the wheel 40 by one step causes the same advance of the disk 17.

A months star 44 with twelve branches 45 is mounted coaxial to and rotating as one with the months wheel 40. Each branch 45 corresponds to one month of the year. The star 44 is positioned by a jumper 46 with two inclined planes, so that, for example, when the tooth 42*a* of the sector 41*a* of the month of April of the wheel 40 is in mesh with the runner 43, the branch 45*a* of the month of April is in the path of a finger 47 mounted on the shaft of a second thirty-one wheel 48. The latter is identical to the first thirty-one wheel 10 and meshes with it. The length of the finger 47 exceeds the radius of the wheel 48.

In operation, the first thirty-one wheel 10 rotates in the CWD and drives, in the CCWD, on the one hand, the second thirty-one wheel 48 and, on the other hand, the lower disk 16 of the clutch runner 15 without having any other impact.

For a thirty-one-day month, the finger 47 is positioned in such a way as to lie flush with the branch 45*b* of the months star 44 corresponding to this month, preferably the first day of the month. Then, when, on this first day, at around midnight, the thirty-one wheel 10 and therefore the wheel 48 and the finger 47 move on by one step, this finger pushes the branch 45*b* and drives the star 44 and the months wheel 40 by one step in the CWD. Henceforth, they are in position ready for the next month.

The wheel 40 and the star 44 rotate in two phases. First of all, rotation is slow when the branch 45*c* pressed against the jumper 46 raises it by sliding along its first inclined plane. Rotation is then quicker, when this branch arrives on the second inclined plane. The pressure then exerted by the jumper 46 accelerates the movement of the star.

The sector 41*b* of the months wheel 40 corresponding to a thirty-one-day month has no teeth and therefore does not drive the intermediate runner 43, even though it faces it as the wheel rotates. The upper disk 17 of the clutch runner 15 therefore does not move either and no movement is transmitted to the thirty-one wheel 10.

As in the case of the manual corrector set out hereinabove, the indicator disk 32 shows, through the window 33, the numeral 31 corresponding to the number of days that the month comprises.

For a thirty-day month, the finger 47 lies flush with the branch 45*a* of the months star 44 corresponding to this month, also the first day of the month. Then, when, at around midnight, the thirty-one wheel 10 and therefore the wheel 48 and the finger 47 move on by one step, this finger pushes the branch 45*a* and drives the star 44 and the months wheel 40 in the CWD.

The teeth 42 of the months wheel 40 and, more specifically, the tooth 42*a* of the sector 41*a* corresponding to this thirty-day month are positioned in such a way as to drive the runner 43 in the CCWD during the rapid phase of the rotation of the star 44. The latter, in its turn, causes the upper disk 17 of the clutch runner 15 to rotate by one step in the CWD, loading its spring but without driving the lower disk 16. The small lever 22 is now positioned in such a way that its long arm 22*b* comes into contact with the finger 14 on the thirtieth day of the month at around midnight. The numeral 30 featuring on the indicator disk 32 appears through the window 33.

In the manner of that which occurs in the case of the manual corrector set out hereinabove, the big lever 25 prevents any rotation of the upper disk 17 in the CWD. On the thirtieth day of the month at around midnight when the finger 14 moves on by one step, it comes into contact with the long arm 22*b* of the small lever 22 which pivots and pushes the long arm 25*b* of the big lever 25. This lever rotates in its turn and releases the upper disk 17. It then jumps by one step in the CCWD, moved by the spring of the clutch runner 15 which suddenly unloads and at the same time drives the lower disk 16. The thirty-one wheel 10 and the date indicator hand 12 therefore also skip a step in the CWD. The hand 12 therefore indicates the 1st day of the month on the series inscribed on the dial 13 and the numeral 31 of the series on the disk 32 once again appears through the window 33.

For twenty-eight-day or twenty-nine-day months of February, the mechanism works in the way just described, but the months wheel 40 causes the intermediate runner 43 to turn and therefore advances the upper disk 17 by three or by two steps.

In order for the abovedescribed mechanism to take account of leap years, the person skilled in the art will have no difficulty in adding a system, known as a Maltese cross system, to the months wheel 40. Thus, the sector corresponding to the month of February exhibits, once every four years, two teeth causing the date indicator hand 12 to skip two steps at the end of the twenty-nine-day month.

Obviously, the months wheel is able to display the current month by means, for example, of an indicator hand mounted on its shaft and pivoting on a small dial.

The above description has been given merely by way of example and does not restrict the scope of the invention. It may easily be adapted to a calendar display mechanism employing disks, these being driven by a transmission gear train from the thirty-one wheel 10.

Likewise, various solutions can be used to display the number of days programmed for the month. For example, a green region inscribed on the upper disk and occupying an angle of 360°/31 may travel under the dial. It can be seen through holes corresponding to the positions occupied by this green region when the corrections have been made in respect of the months comprising 28, 29, 30 or 31 days. The portions adjacent to the green region are advantageously red in color to signal clearly that the numerals in the series 28, 29, 30, 31 to which the red corresponds do not indicate the number of days in the current month.

In another, even simpler, solution, a hand mounted to rotate as one with the shaft of the upper disk 17 indicates, on a portion of the dial, the number of days that the month in progress should contain, according to the actual status of the corrector.

The invention claimed is:

1. A calendar corrector intended to fit in a movement of a timepiece equipped with a calendar-display and with a thirty-one wheel that makes one revolution in thirty-one days, the calendar corrector comprising:

a manual control allowing information relating to the fact that the month in progress comprises fewer than thirty-one days to be input, and programming means comprising a clutch runner equipped with two coaxial toothed disks, including a first disk that can be rotationally driven in a first direction by the thirty-one wheel and a second disk that can be rotationally driven in a second direction, opposite to the first direction, by the control, so that, at the end of the month in progress, the display is automatically corrected.

2. The calendar corrector of claim 1, wherein the disks are coupled together by a spring and by a system of pawls which are arranged in such a way that:

the first disk rotates in the first direction independently of the second disk, the second disk drives the first disk when it rotates in the first direction, the second disk does not drive the first disk when it rotates in the second direction, at a time merely loading the spring, and in that the programming means further comprises:

a finger fixed to the thirty-one wheel, a first lever pivotably mounted on the second disk and that can be actuated by the finger on the last day of the month, and a second lever mounted independent of the clutch runner, that can be actuated by the first lever when the latter is moved by the finger, immobilizing the second disk and releasing it when actuated in such a way that, subjected to the action of the spring, the first disk progresses rapidly in order to correct the calendar display.

3. The calendar corrector of claim 2, wherein the first lever is pivotably mounted on one face of the second disk and comprises two arms, the first facing toward the inside and the second toward the outside of the disk, the outer arm being held pressed against a stop positioned at the periphery of the disk, while its end lies flush with the edge of the disk.

4. The calendar corrector of claim 2, wherein the second lever comprises:

a first arm positioned at the second disk and ending in a lug that a jumper presses against the toothset of the disk so as to prevent it from rotating in the first direction, and a second arm arranged on the second disk and provided with a shoulder designed in such a way as to take the thrust of the inner arm of the first lever and ending in a boss intended to experience the action of a safety block riveted to one face of the second disk when the latter pivots in the second direction.

5. The calendar corrector of claim 2, wherein the manual control comprises a push-button accessible to the wearer of the timepiece and arranged in such a way that pressing it causes the second disk to move on by one step.

6. The calendar corrector of claim 3, wherein the manual control comprises a push-button accessible to the wearer of the timepiece and arranged in such a way that pressing it causes the second disk to move on by one step.

7. The calendar corrector of claim 4, wherein the manual control comprises a push-button accessible to the wearer of the timepiece and arranged in such a way that pressing it causes the second disk to move on by one step.

8. The calendar corrector of claim 2, further comprising an indicator system collaborating with the second disk of the clutch runner in order to display the number of days in the month in progress for which correction is programmed.

9. The calendar corrector of claim 3, further comprising an indicator system collaborating with the second disk of the clutch runner in order to display the number of days in the month in progress for which correction is programmed.

10. The calendar corrector of claim 4, further comprising an indicator system collaborating with the second disk of the clutch runner in order to display the number of days in the month in progress for which correction is programmed.

11. The calendar corrector of claims 4, wherein the end of the first arm of the second lever exhibits a boss and the second disk of the clutch runner is provided with a block intended to push the boss when the disk rotates excessively, so as to cause the lever to pivot and allow the spring to return to its rest position.

12. A calendar corrector intended to fit in a movement of a timepiece equipped with a calendar-display and with a thirty-one wheel that makes one revolution in thirty-one days, the calendar corrector comprising:

an automatic control which, during each month comprising fewer than thirty-one days, produces information relating to the correction that will have to be made at the end of the month, and programming means comprising a clutch runner equipped with two coaxial toothed disks, including a first disk that can be rotationally driven in a first direction by the thirty-one wheel and a second disk that can be rotationally driven in a second direction, opposite to the first direction, by the control, so that, at the end of the month in progress, the display is automatically corrected.

13. The calendar corrector of claim 12, wherein the disks are coupled together by a spring and by a system of pawls which are arranged in such a way that:

the first disk rotates in the first direction independently of the second disk, the second disk drives the first disk when it rotates in the first direction, the second disk does not drive the first disk when it rotates in the second direction, at a time merely loading the spring, and in that the programming means further comprises:

a finger fixed to the thirty-one wheel, a first lever pivotably mounted on the second disk and that can be actuated by the finger on the last day of the month, and a second lever mounted independent of the clutch runner, that can be actuated by the first lever when the latter is moved by the finger, immobilizing the second disk and releasing it when actuated in such a way that, subjected to the action of the spring, the first disk progresses rapidly in order to correct the calendar display.

14. The calendar corrector of claim 13, wherein the first lever is pivotably mounted on one face of the second disk and comprises two arms, the first facing toward the inside and the second toward the outside of the disk, the outer arm being held pressed against a stop positioned at the periphery of the disk, while its end lies flush with the edge of the disk.

15. The calendar corrector of claim 13, wherein the second lever comprises:

a first arm positioned at the second disk and ending in a lug that a jumper presses against the toothset of the disk so as to prevent it from rotating in the first direction, and a second arm arranged on the second disk and provided with a shoulder designed in such a way as to take the thrust of the inner arm of the first lever and ending in a boss intended to experience the action of a safety block riveted to one face of the second disk when the latter pivots in the second direction.

16. The calendar corrector of claim 13, wherein the automatic control comprises:

a months wheel divided into sectors each corresponding to one month of the year, the sectors being either devoid of teeth if they are identified with a thirty-one-day month or equipped with one, two or three teeth for months comprising thirty, twenty-nine or twenty-eight days, respectively, a months star mounted coaxial to and rotating as one with the months wheel, defining branches each one corresponding to one of the sectors, an intermediate runner driven by the teeth of the months wheel, itself meshing with the second disk of the clutch runner, and means for causing the months wheel and the months star to rotate in such a way that, at the start of each month, one of the sectors that corresponds to the following month lies facing the runner and, if it comprises at least one tooth, it drives the runner as the date moves on to the next month.

17. The calendar corrector of claim 16, wherein the means for causing the months wheel and the months star to rotate comprises:

a second thirty-one wheel identical to the first thirty-one wheel and meshing with it, and a finger mounted on this wheel and intended to collaborate with the months star.

18. The calendar corrector of claim 14, wherein the automatic control comprises:

a months wheel divided into sectors each corresponding to one month of the year, these sectors being either devoid of teeth if they are identified with a thirty-one-day month or equipped with one, two or three teeth for months comprising thirty, twenty-nine or twenty-eight days, respectively, a months star mounted coaxial to and rotating as one with the months wheel, defining branches each one corresponding to one of the sectors, an intermediate runner driven by the teeth of the months wheel, itself meshing with the second disk of the clutch runner, and means for causing the months wheel and the months star to rotate in such a way that, at the start of each month, one of the sectors that corresponds to the following month lies facing the runner and, if it comprises at least one tooth, it drives the runner as the date moves on to the next month.

19. The calendar corrector of claim 18, wherein the means for causing the months wheel and the months star to rotate comprises:

a second thirty-one wheel identical to the first thirty-one wheel and meshing with it, and a finger mounted on this wheel and intended to collaborate with the months star.

20. The calendar corrector of claim 15, wherein the automatic control comprises:

a months wheel divided into sectors each corresponding to one month of the year, these sectors being either devoid of teeth if they are identified with a thirty-one-day month or equipped with one, two or three teeth for months comprising thirty, twenty-nine or twenty-eight days, respectively, a months star mounted coaxial to and rotating as one with the months wheel, defining branches each one corresponding to one of the sectors, an intermediate runner driven by the teeth of the months wheel, itself meshing with the second disk of the clutch runner, and means for causing the months wheel and the months star to rotate in such a way that, at the start of each month, one of the sectors that corresponds to the following month lies facing the runner and, if it comprises at least one tooth, it drives the runner as the date moves on to the next month.

21. The calendar corrector of claim 20, wherein the means for causing the months wheel and the months star to rotate comprises:

a second thirty-one wheel identical to the first thirty-one wheel and meshing with it, and a finger mounted on this wheel and intended to collaborate with the months star.

22. The calendar corrector of claim 13, further comprising an indicator system collaborating with the second disk of the clutch runner in order to display the number of days in the month in progress for which correction is programmed.

23. The calendar corrector of claim 14, further comprising an indicator system collaborating with the second disk of the clutch runner in order to display the number of days in the month in progress for which correction is programmed.

24. The calendar corrector of claim 15, further comprising an indicator system collaborating with the second disk of the clutch runner in order to display the number of days in the month in progress for which correction is programmed.

25. The calendar corrector of claim 15, wherein the end of the first arm of the second lever exhibits a boss and the second disk of the clutch runner is provided with a block intended to push the boss when the disk rotates excessively, so as to cause the lever to pivot and allow the spring to return to its rest position.

* * * * *